US010219610B1

(12) United States Patent
Henkel

(10) Patent No.: US 10,219,610 B1
(45) Date of Patent: Mar. 5, 2019

(54) MULTI-TOOL HOLDER

(71) Applicant: Kristian Henkel, Mesa, AZ (US)

(72) Inventor: Kristian Henkel, Mesa, AZ (US)

( * ) Notice: Subject to any disclaimer, the term of this patent is extended or adjusted under 35 U.S.C. 154(b) by 0 days.

(21) Appl. No.: 15/711,517

(22) Filed: Sep. 21, 2017

(51) Int. Cl.

| | |
|---|---|
| ***A45F 5/00*** | (2006.01) |
| ***A45F 5/02*** | (2006.01) |
| *B26B 11/00* | (2006.01) |
| *B25F 1/04* | (2006.01) |

(52) U.S. Cl.
CPC ..... *A45F 5/021* (2013.01); *A45F 2200/0575* (2013.01); *B25F 1/04* (2013.01); *B26B 11/001* (2013.01)

(58) Field of Classification Search
CPC .... A45F 2200/0575; A45F 5/021; A45F 5/00; Y10S 224/904; B25F 1/00; B25F 1/003; B25F 1/006; B25F 1/02; B25F 1/04
USPC ..... 224/242, 245, 904
See application file for complete search history.

(56) References Cited

U.S. PATENT DOCUMENTS 3,777,953 A * 12/1973 Lewis ..... A45C 11/10 224/152
4,299,344 A * 11/1981 Yamashita ..... H04B 1/3888 224/242
4,529,111 A * 7/1985 Hayakawa ..... A44B 11/005 224/163
5,697,538 A * 12/1997 Goldenberg ..... G08B 3/1058 224/245
D392,097 S * 3/1998 Pottala ..... D3/218
5,755,367 A * 5/1998 Yamada ..... H04B 1/086 224/245
5,810,222 A * 9/1998 Shoemaker ..... F41C 33/0227 224/192
5,898,647 A * 4/1999 Goradesky ..... G04B 37/1433 368/83
5,967,641 A * 10/1999 Sung ..... B25B 23/18 362/154
D415,890 S * 11/1999 Eriksson ..... D3/220
D462,514 S * 9/2002 Rivera ..... D3/228
8,056,714 B2 * 11/2011 Carnevali ..... H04M 1/04 206/305
8,322,586 B2 * 12/2012 Davis ..... A45F 5/02 224/197
8,376,199 B2 * 2/2013 Ellis ..... A45F 5/02 224/163
9,504,310 B2 * 11/2016 Foreman ..... A45F 5/021
9,581,421 B2 * 2/2017 Sitz ..... F42B 39/08
10,085,547 B1 * 10/2018 Cummings ..... A45F 5/021
2003/0141332 A1 * 7/2003 Rivera ..... A45F 5/02 224/245
2004/0195128 A1 * 10/2004 Chen ..... B25H 3/00 206/349
2005/0242145 A1 * 11/2005 Wang ..... A45F 5/021 224/666

(Continued)

*Primary Examiner* — Justin Larson
(74) *Attorney, Agent, or Firm* — Spencer Fane LLP; Steven J. Laureanti

(57) ABSTRACT

A multi-tool holder is disclosed including an elongated planar member with a track configured to receive a multi-tool and tool clip. The tool clip is coupled with the elongated planar member and includes one or more prongs that reversibly mate with a port of the multi-tool, wherein the multi-tool includes a mechanism configured to release the multi-tool from the tool clip in response to movement of the mechanism in a first direction.

19 Claims, 6 Drawing Sheets

(56) References Cited

U.S. PATENT DOCUMENTS

| | | | | |
|---|---|---|---|---|
| 2006/0022002 | A1* | 2/2006 | Marks | A45F 5/00 224/268 |
| 2007/0241159 | A1* | 10/2007 | Chang | A45F 5/02 224/677 |
| 2011/0041256 | A1* | 2/2011 | Ellis | A45F 5/02 7/128 |
| 2016/0360870 | A1* | 12/2016 | Langenwalter | A45F 5/021 |
| 2017/0273446 | A1* | 9/2017 | Zentil | A45F 5/021 |

* cited by examiner

MULTI-TOOL HOLDER

TECHNICAL FIELD

The present disclosure relates generally to a holder for a multi-tool and specifically to a multi-tool holder comprising attachment points for one or more accessories.

BACKGROUND

Many occupations benefit from the utility provided by multi-tool devices. These devices provide several commonly-used tools in a single device. However, the utility of multi-tools is often mitigated by the limited functionality of the tools that will conveniently fit within a compact and portable device. This limited functionality is undesirable.

SUMMARY

A multi-tool holder is disclosed. The multi-tool holder includes an elongated planar member and a tool clip. The elongated planar member includes a track configured to receive a multi-tool and tool clip. The tool clip is coupled with the elongated planar member and includes one or more prongs that reversibly mate with a port of the multi-tool. The multi-tool also includes a mechanism configured to release the multi-tool from the tool clip in response to movement of the mechanism in a first direction.

BRIEF DESCRIPTION OF THE DRAWINGS

A more complete understanding of the present invention may be derived by referring to the detailed description when considered in connection with the following illustrative figures. In the figures, like reference numbers refer to like elements or acts throughout the figures.

DETAILED DESCRIPTION

Figure 1:
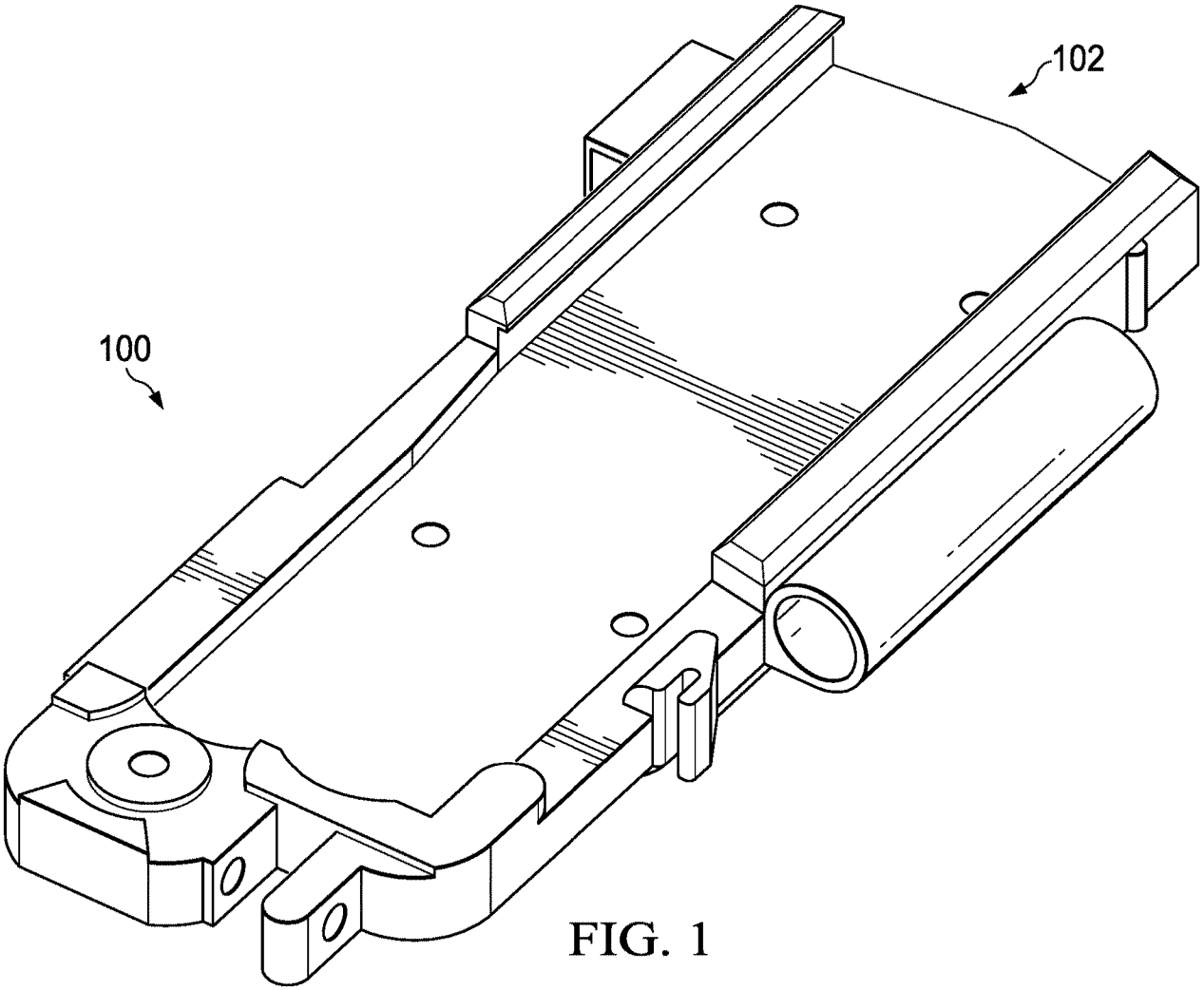
FIG. 1 illustrates a holder according to a first embodiment.

Aspects and applications of the invention presented herein are described below in the drawings and detailed description of the invention. Unless specifically noted, it is intended that the words and phrases in the specification and the claims be given their plain, ordinary, and accustomed meaning to those of ordinary skill in the applicable arts.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

FIG. 1 illustrates holder 100 according to a first embodiment. Holder 100 comprises an elongated planar member comprising a track 102 that forms a slot in holder 100 configured to slidibly couple with a knife and/or multi-tool 200 (FIG. 2), such as, for example, the LEATHERMAN CHARGE and LEATHERMAN WAVE multi-tools. By coupling multi-tool 200 with holder 100, multi-tool 200 may be worn on a belt, which makes multi-tool 200 more easily accessible and eliminates wearing of fabric at pocket corners.

Figure 2:
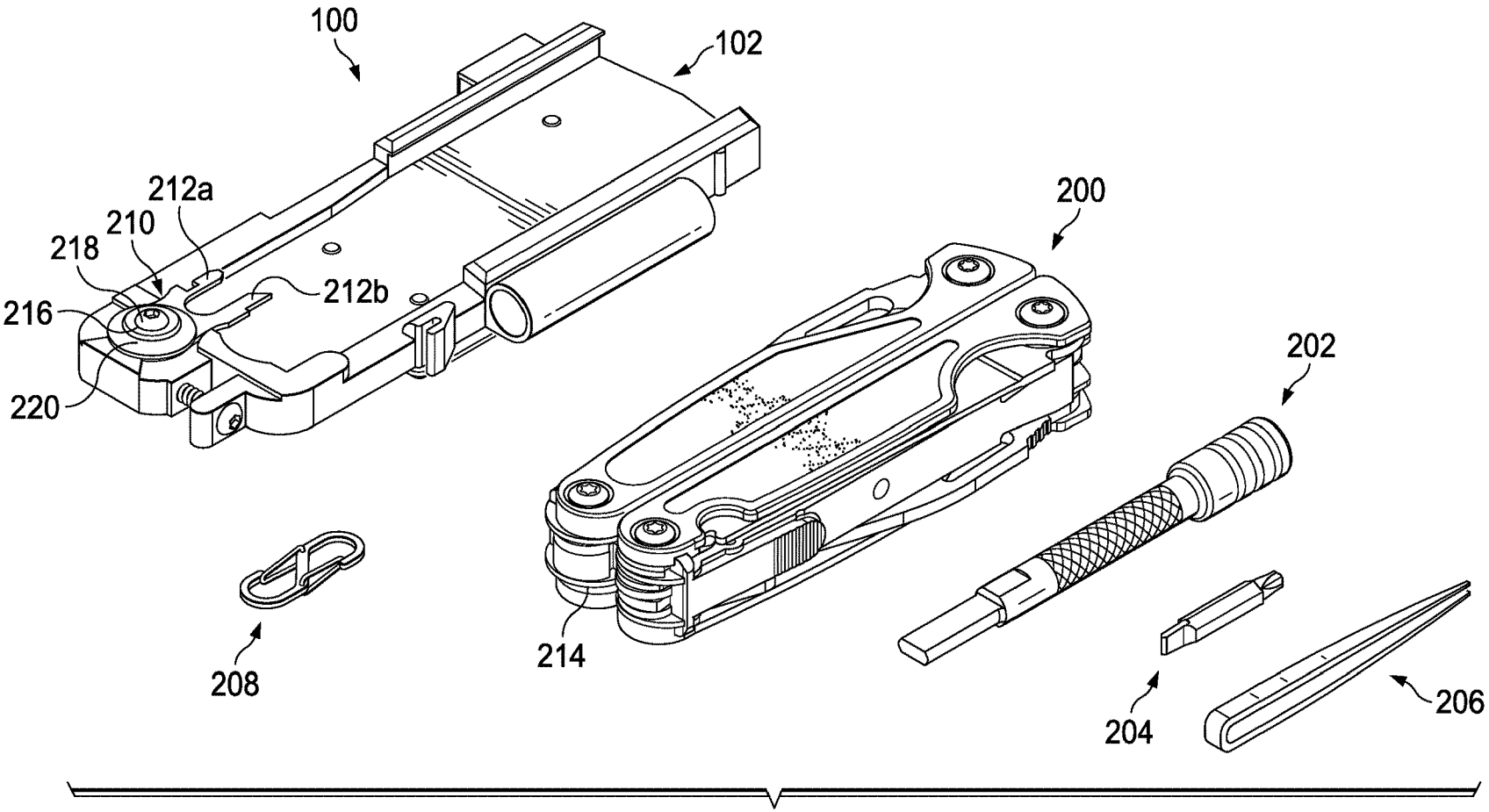
FIG. 2 illustrates the holder of FIG. 1, a multi-tool, and accessories, according to an embodiment.

FIG. 2 illustrates holder 100 of FIG. 1, multi-tool 200, and accessories, according to an embodiment. Multi-tool 200 may comprise, for example, a device comprising one or more tools coupled with each other to form a compact and multi-purpose object comprising one or more tools. These tools may comprise, for example, a knife, screwdriver, wrench, scissors, can opener, saw, pliers, wire cutters, crimpers, cutting hook, ruler, and the like. Accessories may comprise, for example, bit extender 202, bit 204, tweezers 206, hook 208, tool clip 210, and the like.

Bit extender 202 comprises a tool extender device comprising an opening on a first end configured to receive bit 204 and a slotted member on a second end configured to couple with an opening on multi-tool 200. Bit 204 comprises an elongated member with a tool bit at one or both ends of the elongated member and a portion of the elongated member having a perimeter that is configured to couple with the opening of bit extender 202. Although a single bit is shown having a flat-head screwdriver tip at a first end, a Phillips-head screwdriver tip at the second end, and a hexagonal perimeter on the portion configured to couple with the opening of bit extender 202, embodiments contemplate any tool bit at one or both ends, including, for example, a hex-bit, Torx-bit, tri-wing, or the like, and any suitable shape for the perimeter.

Tweezers 206 comprise two spring-loaded arms configured to manipulate small objects. Hook 208 comprises one or more spring-loaded hooks configured to couple holder 100 to any other hookable object, including, for example, key rings, belt loops, a lanyard, or the like. Tool clip 210 comprises one or more prongs 212*a*-212*b* configured to couple with a corresponding port 214 in multi-tool 200, as explained in more detail below. Tool clip 210 may couple with tool clip attachment opening 216 by fastener 218 that couples tool clip 210 to holder 100 by placing fastener through an opening of the tool clip through tool clip attachment opening 216 wherein the corresponding opening in the elongated planar member comprises a button platform 220. Although particular attachment points are described above, embodiments contemplate any suitable attachment points for any accessories that may be needed for use with multi-tool 200. Additionally, holder 100 comprises one or more attachment points for accessories or the like.

Figure 3:
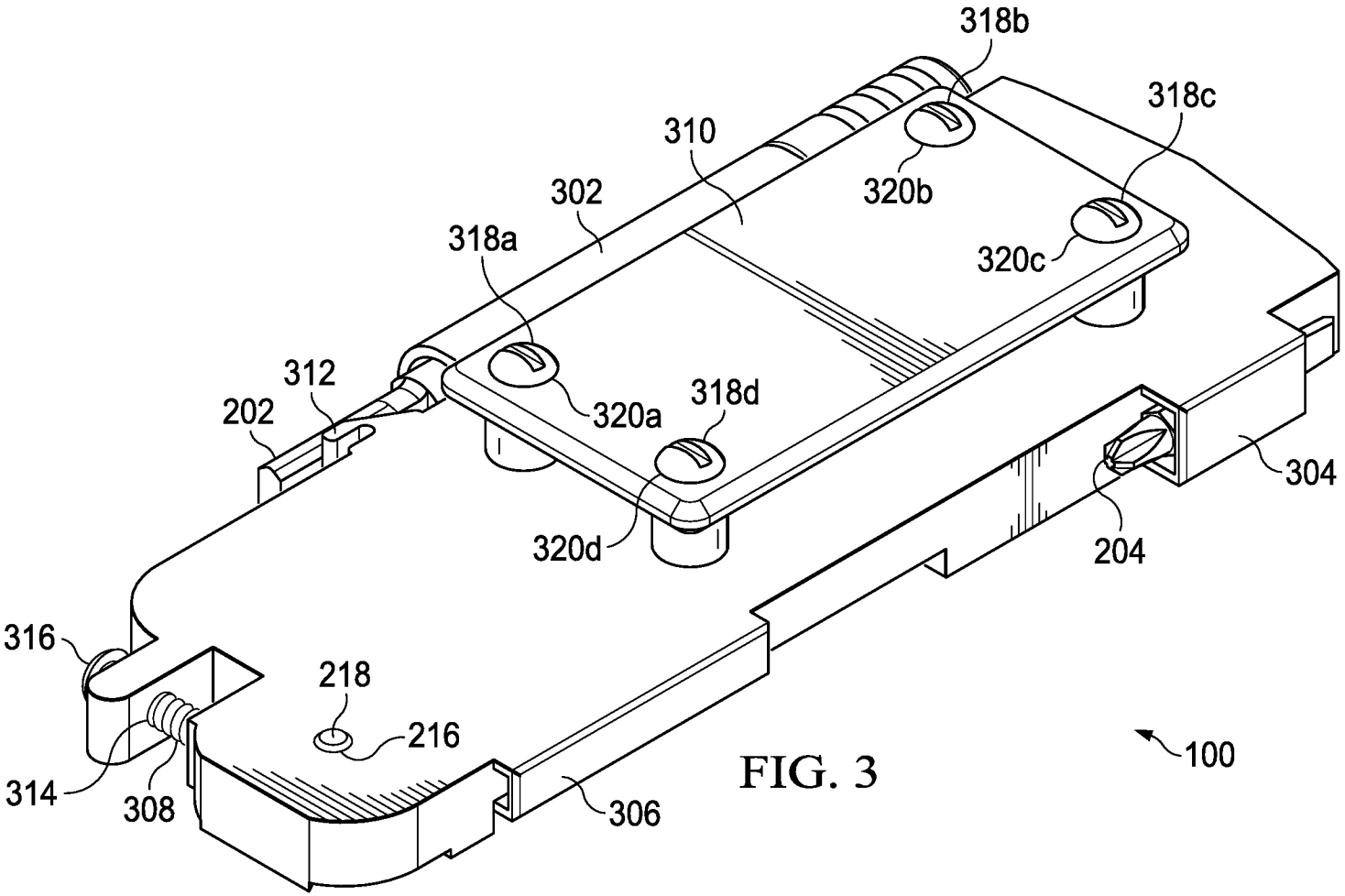
FIG. 3 illustrates the holder of FIG. 1, according to an embodiment.

FIG. 3 illustrates holder 100 of FIG. 1, according to an embodiment. As discussed above, holder 100 may comprise one or more attachment points for accessories. For example, holder 100 may comprise bit extender tube 302, bit slot 304, tweezer slot 306, hook attachment bar 308, and belt clip 310. Bit extender 202 may slidibly couple with bit extender tube 302. According to embodiments, bit extender 202 may slide through an opening in bit extender tube 302 comprising an interior surface that frictionally mates with the outer surface of bit extender 202, so that bit extender 202 may be held within bit extender tube 302 by friction and be slid outward from bit extender tube 302 by applying force to bit extender 202, thereby removing it from bit extender tube 302. According to embodiments, holder 100 comprises bit extender clip 312 which provides additional force to hold bit extender 302 in place. Bit extender clip 312 may, according to embodiments, be configured to interact with a mating surface of bit extender 202 to provide a frictional force that holds bit extender 202 securely to holder 100, but which may be removed by placing a small force to one end of bit extender 202 to overcome the force of bit extender clip 312 and bit extender opening 302 to slide bit extender 202 out of bit extender opening 302 and away from holder 100.

In a similar manner, bit 204 may slidibly couple with bit slot 304 by a frictional force holding bit 204 within an opening formed by bit slot 304. Bit 204 may be removed by placing a small force to one end of bit 204 to overcome the force of bit slot 304 to slide bit 204 out of bit slot 304 and away from holder 100.

Additionally, tweezers 206 may slidibly couple with tweezer slot 306 by a frictional force holding tweezers 206 within an opening formed by tweezer slot 306. Tweezers 206 may be removed by placing a small force to one end of tweezers 206 to overcome the compressive force of tweezer slot 306 against the expansive force of the arms of tweezers 206 to slide tweezers 206 out from tweezer slot 306. According to embodiments, hook 204 may couple with hook attachment bar 308 that is inserted through opening 314. According to embodiments, hook attachment bar 308 comprises the threaded portion of a screw 316 inserted through opening 314.

Belt clip 310 comprises a flat elongated member which is coupled to holder 100 by, for example, four screws 318*a*-318*d*. Screws 318*a*-318*d* may couple belt clip 310 with holder 100 and one or more spacers 320*a*-320*d*. Spacers 320*a*-320*d* hold belt clip 310 away from a lower surface of holder 100 such that a space is formed which is configured to receive a belt placed through the space to hold holder 100 in place. According to embodiments, belt clip 310 may be attached only at a single end so that belt clip 310 may slide over a piece of fabric. According to some embodiments, belt loop may be spring-loaded and removably clip over a belt. According to some embodiments, the orientation of the holder may be adjusted in relationship to a belt of flexible material by placing the material through the loop lengthwise, widthwise, in an upward position, or a downward position. Although particular orientations are disclosed, embodiments contemplate positioning the holder in any suitable position to make accessing multi-tool 200 easier.

According to embodiments, different embodiments of holder 100 may comprise a different set of one or more accessories that are directed to particular tasks or professions. For example, one embodiment may comprise a camping edition, which comprises a set of accessories directed toward camping tasks. Another embodiment may comprise a mechanic edition, which comprises a set of accessories directed toward mechanic tasks. Other embodiments, may comprise other editions directed toward any suitable task or profession, such as, for example, construction, electrical work, engineering, carpentry, or the like.

Figure 4:
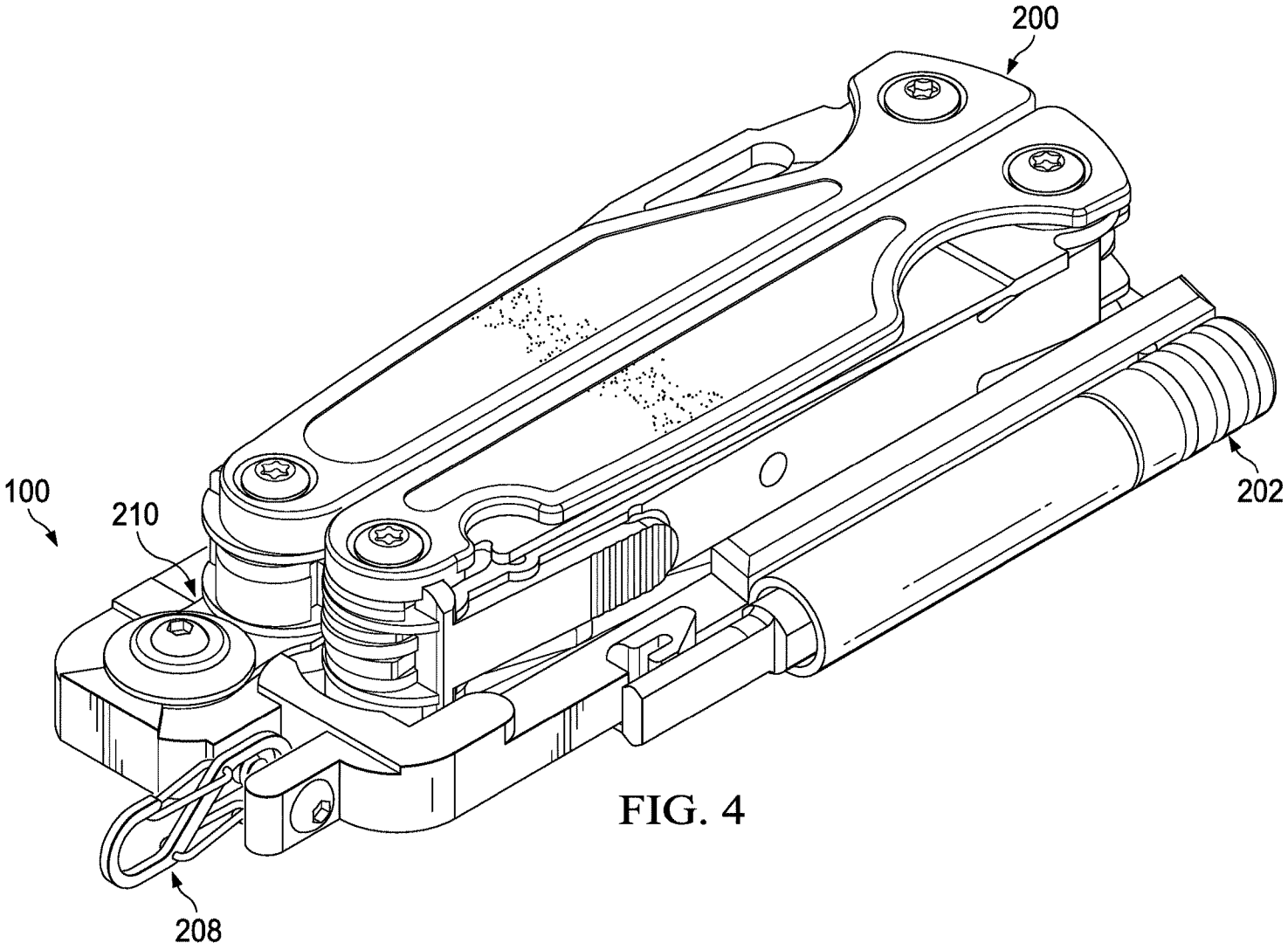
FIG. 4 illustrates the holder of FIG. 1 coupled with a multi-tool and accessories, according to an embodiment.

FIG. 4 illustrates holder 100 of FIG. 1 coupled with multi-tool 200 and accessories, according to an embodiment. Multi-tool 200 is placed in track 102 and is coupled with tool clip 210. According to embodiments, tool clip 210 is shaped to reversibly couple with multi-tool 200.

Figure 5:
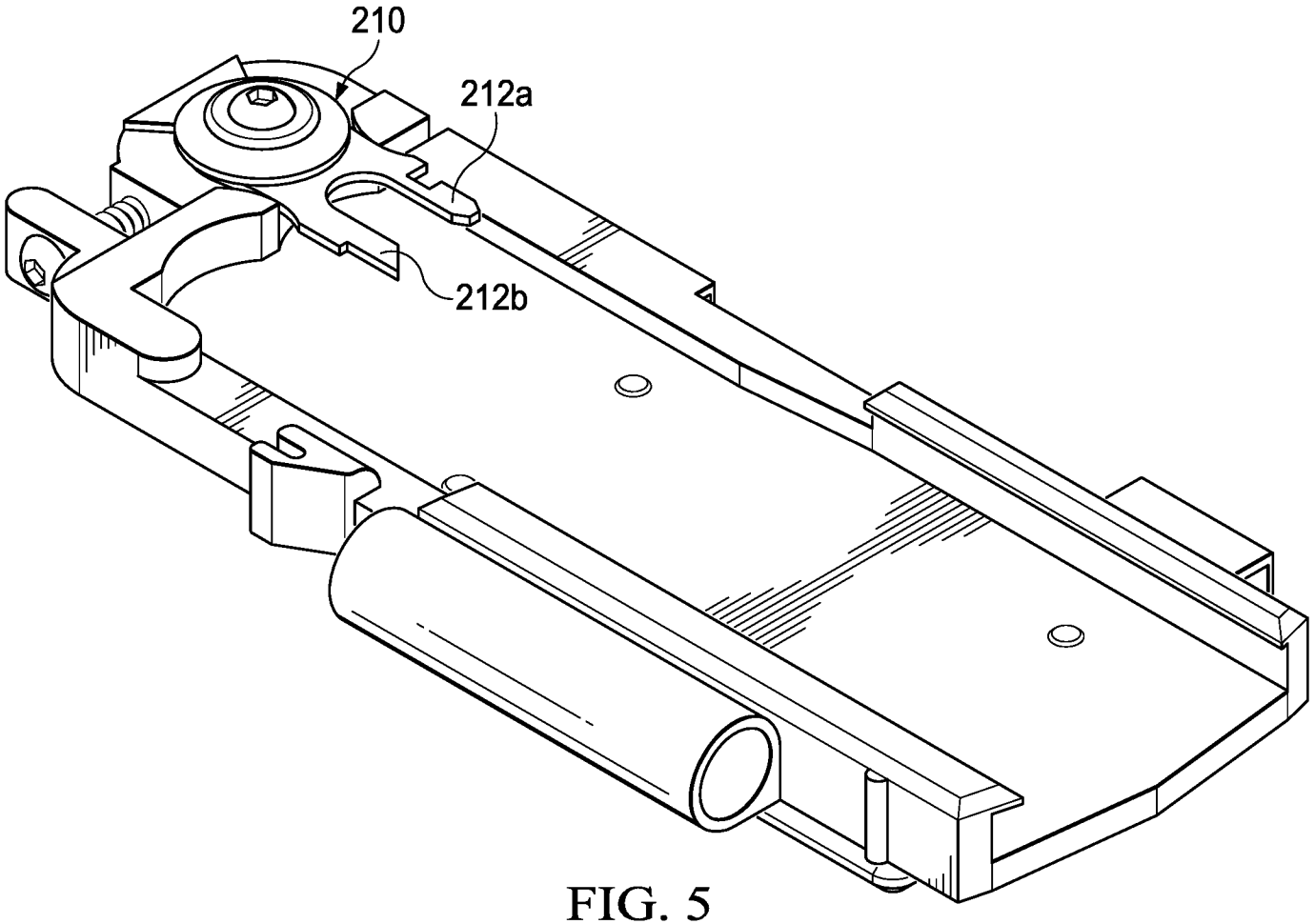
FIG. 5 illustrates the holder of FIG. 1, according to a further embodiment.

FIG. 5 illustrates holder 100 of FIG. 1, according to a further embodiment. As discussed above, tool clip 210 comprises one or more prongs 212*a*-212*b* that are configured to be received by one or more corresponding ports 214 in multi-tool 200. According to embodiments, multi-tool 200 may comprise a clip, button, or other like mechanism for moving a pin, internal to port 214, that retards the movement of multi-tool 200 with respect to the holder 200. For example, the pin may be spring loaded such that when multi-tool 200 is slid into track 102, port 214 receives prongs 212*a*-212*b* and the pin engages one or more prongs 212*a*-212*b* to hold multi-tool 200 in track 102. In response to a user movement of a clip, button, or the like, the position of the pin is shifted so that the pin is no longer engaged with one or more prongs 212*a*-212*b* and multi-tool 200 is released from holder 100. Although a particular tool clip 210 is described, embodiments contemplate any suitable mechanism to couple a multi-tool 200 with holder 100 according to particular needs. For example, tool clip 210 may comprise a different shape to fit with multi-tools comprising other ports, pins, or locking mechanisms to couple any particular multi-tool with holder 100, according to particular needs.

Similarly, track 102 may be formed of different shapes to couple with various multi-tools comprising other ports, pins, or locking mechanisms.

Figure 6:
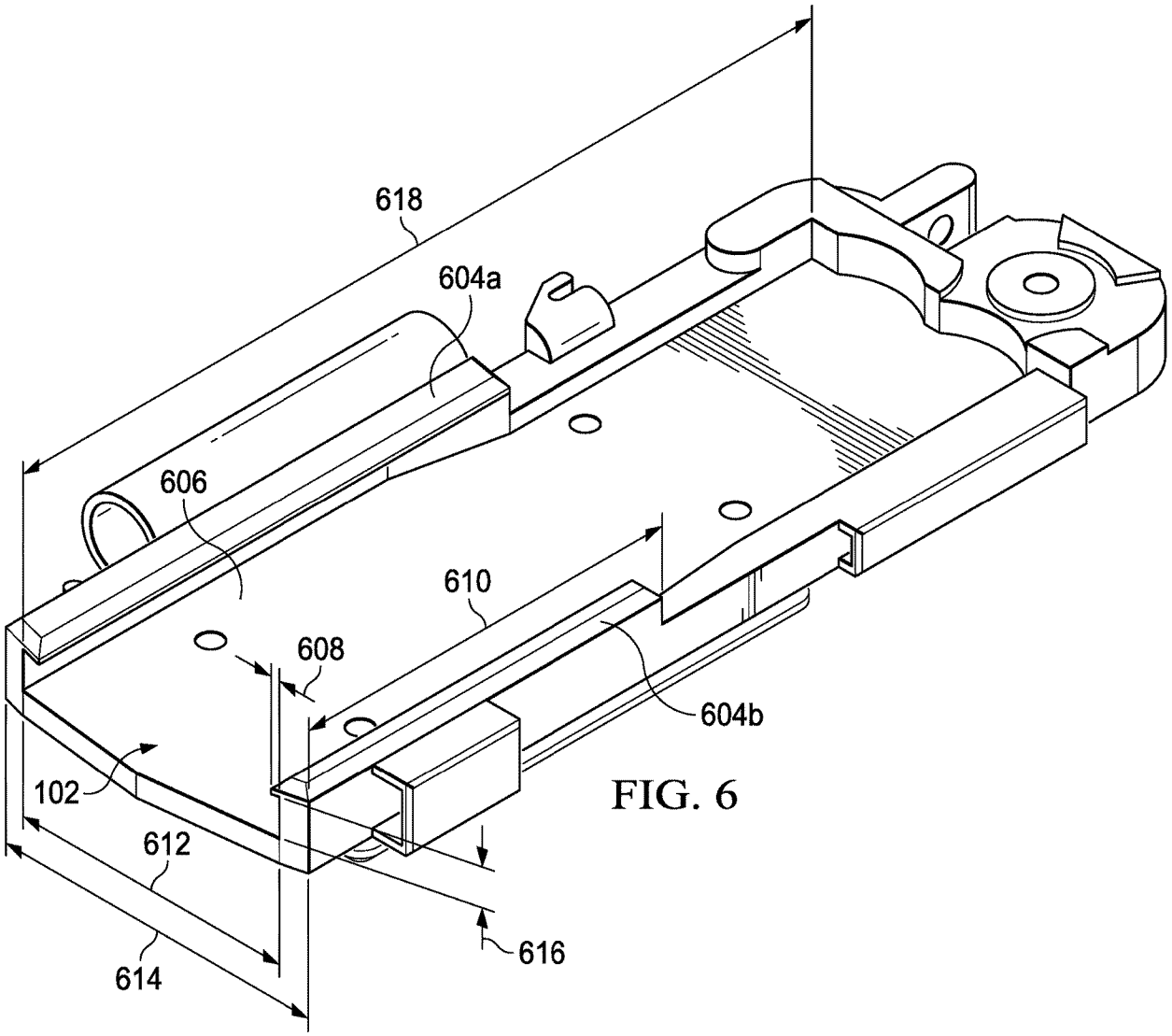
FIG. 6 illustrates the holder of FIG. 1, according to a further embodiment.

FIG. 6 illustrates holder 100 of FIG. 1, according to a further embodiment. According to embodiments, track 102 is formed from tabs 604*a*-604*b* that comprise lower surfaces that, at least in part, extend outward from holder 100 to overhang track lower surface 606. The overhang of tabs 604*a*-604*b* may comprise a width 608 and a length 610 that is configured to mate with an upper surface of a multi-tool 200, such that the lower surface of tabs 604*a*-604*b* extends outward over multi-tool 200 to hold the multi-tool 200 within track 102, but, at the same time, does not interfere with multi-tool 200 from sliding in and out of track 102.

Similarly, track 102 comprises a width 612 which is less than the width 614 of holder 100, a height 616, and a length 618. Width 612, height 616, and length 618 of track 102 are sized to hold the multi-tool 200 within track 102, but, at the same time, do not interfere with multi-tool 200 from sliding in and out of track 102. Although particular embodiments of track 102 are described, embodiments contemplate any suitable arrangement of tabs 604*a*-604*b* (including any suitable width 608 and length 610) and any suitable width 612, height 616, and length 618 of track 102 configured to hold a multi-tool of any particular shape.

Implementations of holder 100 and components of the same may be formed of any of many different types of materials or combinations thereof that can readily be formed into shaped objects provided that the materials selected are consistent with the intended operation of a multi-tool holder implementation. For example, the components may be formed of: rubbers (synthetic and/or natural) and/or other like materials; polymers such as thermoplastics (such as ABS, Fluoropolymers, Polyacetal, Polyamide; Polycarbonate, Polyethylene, Polypropylene (low or high density), Polysulfone, and/or the like), thermosets (such as Epoxy, Phenolic Resin, Polyimide, Polyurethane, Silicone, and/or the like), any combination thereof, and/or other like materials; carbon-fiber, aramid-fiber, any combination thereof, and/or other like materials; composites and/or other like materials; metals; alloys; any other suitable material; and/or any combination of the foregoing thereof. According to some embodiments, holder 100 comprises a waterproof material.

Various implementations of holder 100 may be manufactured using conventional procedures as added to and improved upon through the procedures described here. Some components defining implementations of holder 100 may be manufactured simultaneously and integrally joined with one another, while other components may be purchased pre-manufactured or manufactured separately and then assembled with the integral components. Accordingly, manufacture of these components separately or simultaneously may involve three-dimensional printing (including Stereolithography (SLA), Digital Light Processing (DLP), Fused deposition modeling (FDM) (including thermoplastic filament extrusion), Selective Laser Sintering (SLS), Selective laser melting (SLM), Electronic Beam Melting (EBM), Laminated object manufacturing (LOM), and the like), vacuum forming, injection molding, blow molding, casting, forging, cold rolling, milling, drilling, reaming, turning, grinding, stamping, pressing, cutting, bending, welding, soldering, hardening, riveting, punching, plating, and/or the like. Components manufactured separately may then be coupled or removably coupled with the other integral components, if necessary, in any manner, such as with adhesive, a weld joint, a solder joint, a fastener (e.g. a bolt and a nut, a screw, a rivet, a pin, and/or the like), washers, retainers, wrapping, wiring, any combination thereof, and/or the like for example, depending on, among other considerations, the particular material forming the components.

Reference in the foregoing specification to "one embodiment", "an embodiment", or "some embodiments" means that a particular feature, structure, or characteristic described in connection with the embodiment is included in at least one embodiment of the invention. The appearances of the phrase "in one embodiment" in various places in the specification are not necessarily all referring to the same embodiment.

While the exemplary embodiments have been shown and described, it will be understood that various changes and modifications to the foregoing embodiments may become apparent to those skilled in the art without departing from the spirit and scope of the present invention.

What is claimed is:

1. A multi-tool holder, comprising:

an elongated planar member comprising a track recessed in a front surface thereof and configured to receive a multi-tool; and a tool clip coupled with the elongated planar member and comprising prongs that define an aperture perpendicular to the front surface that reversibly mates with a port of the multi-tool, wherein the multi-tool comprises a mechanism configured to release the multi-tool from the tool clip in response to movement of the mechanism in a first direction.

2. The multi-tool holder of claim 1, further comprising:

the elongated planar member comprising at least two outer surfaces; and a bit extender tube coupled to one of the at least two outer surfaces of the elongated planar member.

3. The multi-tool holder of claim 2, further comprising:

tabs coupled with the elongated planar member and the tabs extend outward over the track.

4. The multi-tool holder of claim 3, further comprising:

a bit slot coupled to one of the at least two outer surfaces of the elongated planar member.

5. The multi-tool holder of claim 4, further comprising:

a bit extender clip configured to reversibly couple to a bit extender, when the bit extender is placed within the bit extender tube.

6. The multi-tool holder of claim 5, wherein one of the at least two outer surfaces comprises a back surface, and a belt clip is coupled to the back surface.

7. The multi-tool holder of claim 6, wherein one of the at least two outer surfaces comprises a tweezer slot.

8. The multi-tool holder of claim 7, wherein the elongated planar member comprises a hook attachment bar.

9. The multi-tool holder of claim 8, wherein the elongated planar member and the bit extender tube are formed of a single piece of polymer.

10. The multi-tool holder of claim 9, wherein the tool clip is coupled to the elongated planar member by a fastener inserted through an opening in the tool clip and a corresponding opening in the elongated planar member, wherein the corresponding opening in the elongated planar member comprises a button platform.

11. A holder, comprising:

an elongated planar member and a tool clip coupled with the elongated planar member, the tool clip coupled with the elongated planar member by a fastener inserted through an opening in the tool clip and a corresponding opening in the elongated planar member; wherein the corresponding opening in the elongated planar member comprises a button platform.

12. The multi-tool holder of claim 11, further comprising:

the elongated planar member comprising a track and at least two outer surfaces;

the tool clip comprising one or more prongs that reversibly mate with a port of the multi-tool, wherein the multi-tool comprises a mechanism configured to release the multi-tool from the tool clip in response to movement of the mechanism in a first direction; and a bit extender tube coupled to one of the at least two outer surfaces of the elongated planar member.

13. The multi-tool holder of claim 12, wherein the elongated planar member further comprises one or more tabs that extend outward over the track.

14. The multi-tool holder of claim 13, wherein the elongated planar member further comprises a bit slot coupled to one of the at least two outer surfaces.

15. The multi-tool holder of claim 14, further comprising a bit extender clip configured to reversibly couple to a bit extender.

16. The multi-tool holder of claim 15, wherein one of the at least two outer surfaces comprises a back surface, and a belt clip is coupled to the back surface.

17. The multi-tool holder of claim 16, wherein one of the at least two outer surfaces comprises a tweezer slot.

18. The multi-tool holder of claim 17, wherein the elongated planar member comprises a hook attachment bar.

19. The multi-tool holder of claim 18, wherein the elongated planar member and a bit extender tube are formed of a single piece of polymer.

* * * * *